US005598827A

United States Patent [19]

Kato

[11] Patent Number: 5,598,827

[45] Date of Patent: Feb. 4, 1997

[54] HIGH PRESSURE FUEL FEEDING DEVICE FOR FUEL INJECTION ENGINE

[75] Inventor: Naoki Kato, Hamamatsu, Japan

[73] Assignee: Sanshin Kogyo Kabushiki Kaisha, Hamamatsu, Japan

[21] Appl. No.: 368,598

[22] Filed: Jan. 4, 1995

Related U.S. Application Data

[62] Division of Ser. No. 959,684, Oct. 13, 1992, Pat. No. 5,404,858.

[30] Foreign Application Priority Data

Oct. 18, 1991 [JP] Japan ..... 3-297696
Oct. 18, 1991 [JP] Japan ..... 3-297697

[51] Int. Cl.[6] ..... F02M 37/04

[52] U.S. Cl. ..... 123/518; 123/533; 123/516

[58] Field of Search ..... 123/516, 468, 123/533, 518, 519, 520, 521

[56] References Cited

U.S. PATENT DOCUMENTS

| | | | |
|---|---|---|---|
| 1,269,787 | 6/1918 | Church . | |
| 3,128,748 | 4/1964 | Goggi | 123/518 |
| 3,363,710 | 1/1968 | Fager . | |
| 3,612,022 | 10/1971 | Bomhard | 123/518 |
| 3,731,665 | 5/1973 | Garcea | 123/518 |
| 4,231,344 | 11/1980 | Urbinati | 123/518 |
| 4,462,158 | 7/1984 | Wehle | 123/516 |
| 4,570,602 | 2/1986 | Atkins et al. . | |
| 4,722,708 | 2/1988 | Baltz | 123/518 |
| 4,784,104 | 11/1988 | Dimond . | |
| 4,809,666 | 3/1989 | Baltz . | |
| 4,955,409 | 9/1990 | Tokuda et al. . | |
| 5,094,217 | 3/1992 | Kaku | 123/533 |
| 5,239,964 | 8/1993 | Diener et al. . | |
| 5,275,145 | 1/1994 | Tuckey | 123/516 |
| 5,309,885 | 5/1994 | Rawlings | 123/516 |
| 5,375,578 | 12/1994 | Kato | 123/533 |
| 5,404,858 | 4/1995 | Kato | 123/516 |

FOREIGN PATENT DOCUMENTS

| | | |
|---|---|---|
| 2623251 | 5/1989 | France . |
| 61-118552 | 6/1986 | Japan . |
| 1215694 | 8/1989 | Japan . |
| 323362 | 1/1991 | Japan . |
| 319464 | 2/1991 | Japan . |
| 331577 | 2/1991 | Japan . |
| 357876 | 3/1991 | Japan . |
| 364658 | 3/1991 | Japan . |
| 1216653 | 12/1970 | United Kingdom . |

*Primary Examiner*—Carl S. Miller
*Attorney, Agent, or Firm*—Knobbe, Martens, Olson & Bear

[57] ABSTRACT

An outboard motor having an fuel/air injection system wherein all of the major components of the fuel portion of the fuel/air injection system are contained within a sealed chamber having a fuel drain and the conduits that supply fuel to the fuel injectors are also contained within fuel collecting conduits so that any fuel leaking will not escape back to the atmosphere. In addition, the air pressure supplied to the fuel/air injectors is regulated and the air relieved for pressure regulation is returned to an air inlet device having a baffle for condensing any fuel in the regulated air and returning the condensed fuel to a vapor separator. The engine is of the V type and major components of the fuel/air injection system are positioned in the valley between the cylinder banks.

13 Claims, 8 Drawing Sheets

HIGH PRESSURE FUEL FEEDING DEVICE FOR FUEL INJECTION ENGINE

This application is a divisional of application Ser. No. 07/959,684, filed Oct. 13, 1992, U.S. Pat. No. 5,404,858.

BACKGROUND OF THE INVENTION

This invention relates to a high pressure fuel feeding system for a fuel injected engine and more particularly to an improved fuel feed system and fuel injection system for an internal combustion engine and particularly that of an outboard motor.

The advantages of fuel injection in maintaining good fuel economy and low exhaust emissions are well acknowledged. For this reason, fuel injection systems are being considered for a wide variety of engine applications. One application where fuel injection has considerable advantages is in the power head of an outboard motor.

One problem particularly acute in conjunction with outboard motors is that the entire engine and most of its supporting systems must be provided in a relatively compact and confined area within the power head of the outboard motor. This can give rise to certain problems, particularly when fuel injection systems are employed. For example, it is the practice to employ a high pressure pump that deliverd fuel under pressure to the fuel injectors of the engine. In order to assure good injection control, however, it is also necessary to provide some form of pressure regulation in the high pressure system supplying the fuel injectors. The pressure is normally regulated by returning excess fuel back to the inlet side of the high pressure pump or to a storage tank contained within the power head. However, this adds significantly to the number of conduits and connections in the injection system and particularly the fuel supply side.

Of course, fuel leakage is always a problem with any type of system. However, the leakage can be a particularly acute problem in conjunction with outboard motors wherein the components are all located close to each other and within a confining protective cowling.

It is, therefore, a principal object of this invention to provide an improved arrangement for insuring against external fuel leakage in the fuel injection system for an engine.

It is a further object of this invention to provide an improved high pressure fuel injection system for an outboard motor and the engine associated therewith.

In addition to the actual conduits that convey the fuel from the pressure pump to the fuel injectors and pressure regulator, there is also a problem of potential leakage in the individual components of the system. In addition to a high pressure pump, a fuel injector and a pressure regulator, it is also the practice frequently to employ additional components in the fuel injection system. For example, a vapor separator is frequently employed in such engines to insure that only liquid fuel is pumped and supplied to the fuel injectors.

It is, therefore, a still further object of this invention to provide an improved arrangement for insuring against external leakage of the various components of the fuel injection system.

It is a further object of this invention to provide an improved arrangement for encapsulating components of the fuel injection system within a container so that any fuel that may leak can be accumulated in this container and cannot come into contact with the engine itself.

Another problem particularly acute with outboard motors is the actual placement of the various components of the fuel injection system relative to the engine. For example, fuel injection systems may be employed in conjunction with V-type engines having angularly disposed cylinder banks. If all of the components are located at one side or the other of the engine, then conduitry must extend back and forth between the cylinder banks and the difference in length of the conduits must be taken into effect in designing the pressure regulation and capacity of the various components.

It is, therefore, a still further object of this invention to provide an improved layout for the fuel injection system components of a V-type engine.

It is a yet further object of this invention to provide an improved fuel injected V-type engine for an outboard motor.

One type of fuel injection system employs injectors which inject not only fuel under pressure but also air under pressure to the engine. With this type of system, the components can become more complicated in that in addition to the fuel pump and pressure regulation for the fuel side of the system, there must also be provided an air compressor and a pressure regulator for the air compressor. In addition, since air and fuel are both supplied to the fuel injectors, there is a possibility that fuel may enter into the air system.

For example, if there is provided an air pressure regulator in the conduit that supplies the fuel/air injectors, the regulation of air pressure by returning some of the air back to the air compressor, can cause fuel to be returned along with air to the air compressor. If fuel vapors are present in the air pumped by the air compressor, then a number of difficulties can arise, for example high power requirements for driving the air compressor.

It is, therefore, a still further object of this invention to provide an improved air supply system for a fuel/air injector arrangement for an internal combustion engine.

It is a further object of this invention to provide an improved vapor separator for the air pressure system of a fuel/air injection system.

SUMMARY OF THE INVENTION

A first feature of the invention is adapted to be embodied in a high pressure fuel injection system that comprises a fuel tank, a high pressure pump for pumping fuel, a pressure regulator for regulating fuel pressure by bypassing fuel, a fuel injector for supplying fuel under high pressure to an engine and conduit means for supplying fuel from the fuel tank to the high pressure pump, for supplying fuel from the high pressure pump to the pressure regulator and to the fuel injector and for conveying fuel bypassed by the pressure regulator back to the system upstream of the high pressure pump. In accordance with this feature of the invention, a fuel collector contains at least a portion of the conduit means for precluding leakage of fuel from the conduit means portion from reaching the atmosphere.

Another feature of the invention is adapted to be embodied in a fuel injection system for an internal combustion engine that comprises the following components: a fuel injector for supplying fuel to the engine, a high pressure fuel pump for pumping fuel and a fuel pressure regulator for regulating the pressure of the fuel supplied by the high pressure pump to the fuel injector. In accordance with this feature of the invention, means enclose at least one of the components in a chamber for accumulating any fuel leakage from that component.

Another feature of the invention is adapted to be embodied in an outboard motor comprised of a power head containing an internal combustion engine consisting of two cylinder banks located in a V with a valley therebetween. Fuel injection means are provided for delivering fuel under pressure to the cylinders of the cylinder banks. A fuel injection system comprises the following components, a high pressure fuel pump, a pressure regulator for regulating the pressure of fuel supplied by said high pressure fuel pump and a vapor separator for separating fuel vapors from the fuel. In accordance with this feature of the invention, at least one of the fuel injection system components is located in the valley and a protective cowling encircles the engine.

Another feature of the invention is adapted to be embodied in a fuel/air injection system for supplying fuel and air under pressure to a fuel/air injector. An air compressor for delivering compressed air to the fuel/air injector is supplied. An air inlet device receives atmospheric air and delivers it to the air compressor. The air inlet device comprises means defining a plenum chamber, an atmospheric air inlet for drawing atmospheric air into the plenum chamber and an air outlet communicating the plenum chamber with the air compressor. A pressure regulating means is provided in communication with the fuel/air injector for regulating the pressure of the air delivered to the fuel/air injector. A relief conduit receives the air relieved by the pressure regulating means and returns the air to the air inlet device. In accordance with this feature of the invention, means in the air inlet device is provided for separating fuel from the air returned to the air inlet device through the return conduit.

DETAILED DESCRIPTION OF THE PREFERRED EMBODIMENT OF THE INVENTION

Figure 1:
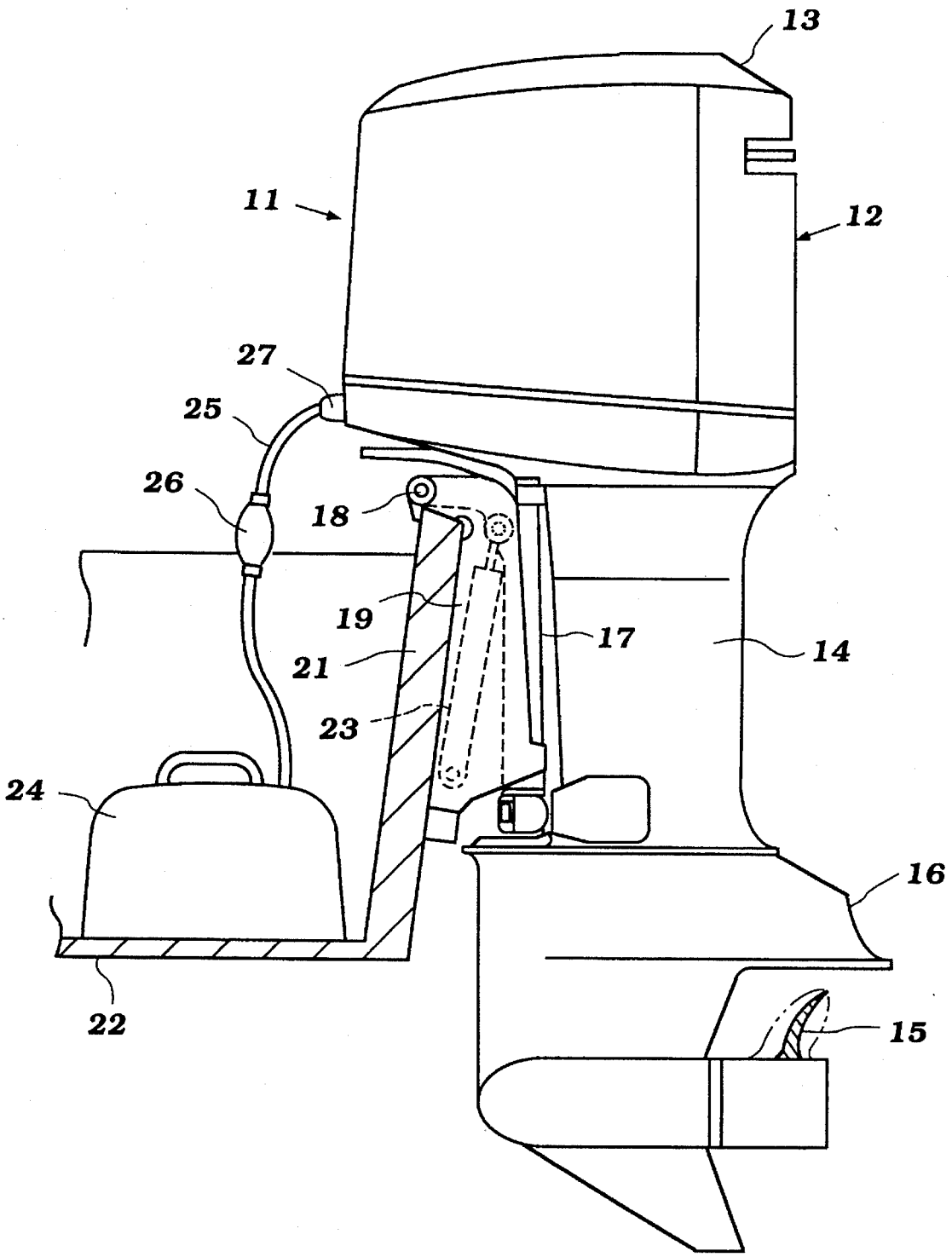
FIG. 1 is a side elevational view of an outboard motor constructed in accordance with an embodiment of the invention, as attached to the transom of a watercraft, shown partially and with portions in section.

Referring now in detail to the drawings and initially to FIG. 1, an outboard motor constructed in accordance with an embodiment of the invention is identified generally by the reference numeral 11. Although the invention is described in conjunction with an outboard motor, wherein it has particular utility, it is to be understood that the invention may be employed in conjunction with other applications for internal combustion engines.

The outboard motor 11 includes a power head, indicated generally by the reference numeral 12 which contains an internal combustion engine, which will be described by reference to the remaining figures, and a surrounding protective cowling 13. The engine contained within the power head 12 drives a vertically positioned driveshaft which is journaled within a driveshaft housing 14 that depends from the power head 12 and which drives a propeller 15 through a forward/neutral/reverse transmission contained within a lower unit 16.

A steering shaft (not shown) is affixed to the driveshaft housing 14 in a known manner is journaled for steering movement about a vertically extending steering axis within a swivel bracket 17. The swivel bracket 17 is, in turn, pivotally connected by means of a pivot pin 18 to a clamping bracket 19 for tilt and trim movement of the outboard motor 11 in a well known manner. The clamping bracket 19 carries a suitable device for attaching the clamping bracket 19 to a transom 21 of an associated watercraft, shown partially and in cross section and identified generally by the reference numeral 22. A hydraulic cylinder assembly, which may include a fluid motor 23 is interposed between the clamping bracket 19 and the swivel bracket 17 for tilt and trim damping and also for power tilt and trim movement, if a fluid motor is incorporated.

The invention relates primarily to the fuel injection system for the engine of the power head 12 and this includes a fuel system that is comprised of a main fuel storage tank 24 that is positioned in the watercraft hull 22. A conduit 25 in which a priming pump 26 is incorporated for connecting the fuel tank 24 with the fuel system of the power head 12 and a quick disconnect coupling 26 is provided for this purpose.

Figure 2:
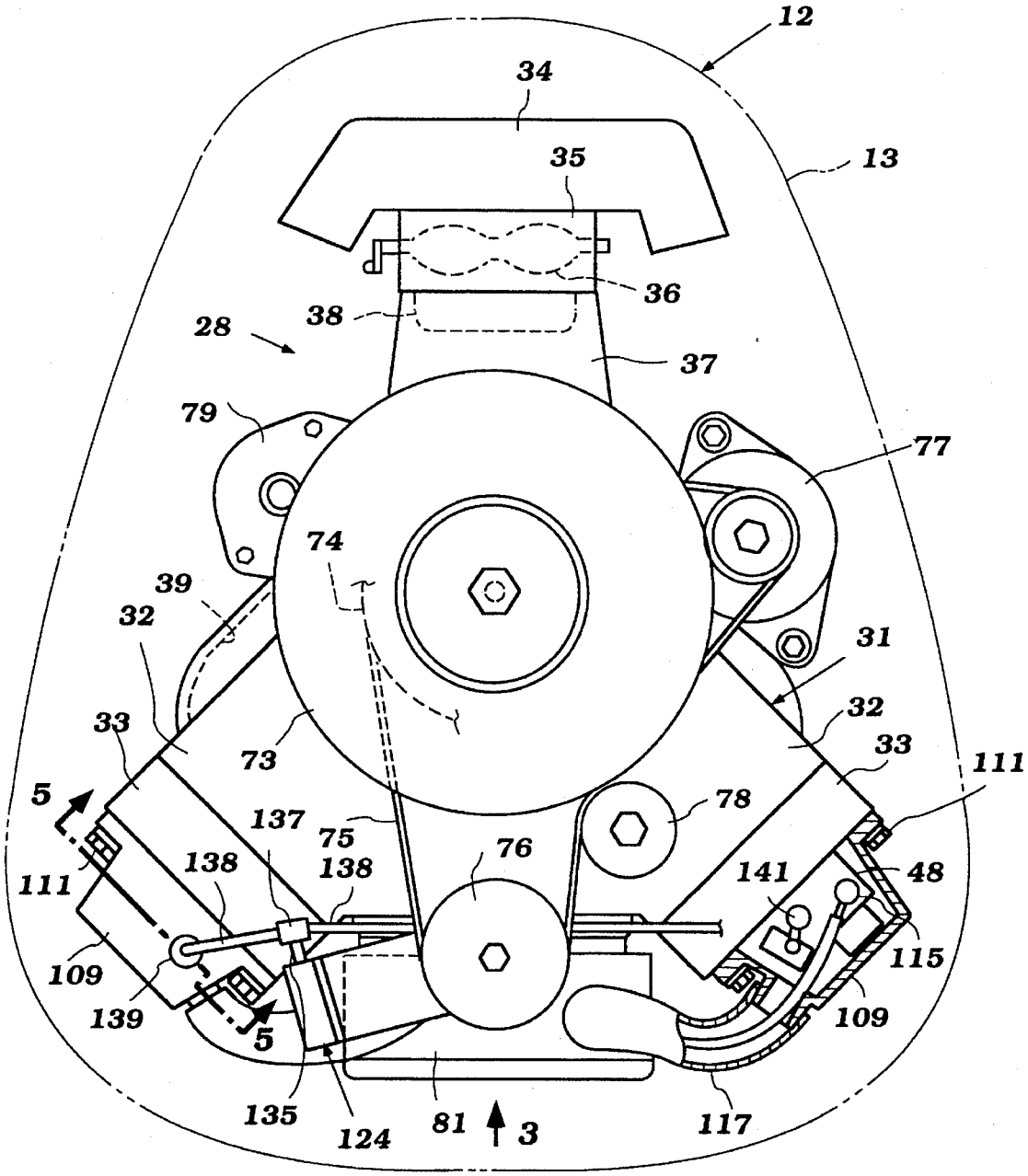
FIG. 2 is an enlarged top plan view of the power head of the outboard motor with the protective cowling shown in phantom.
Figure 3:
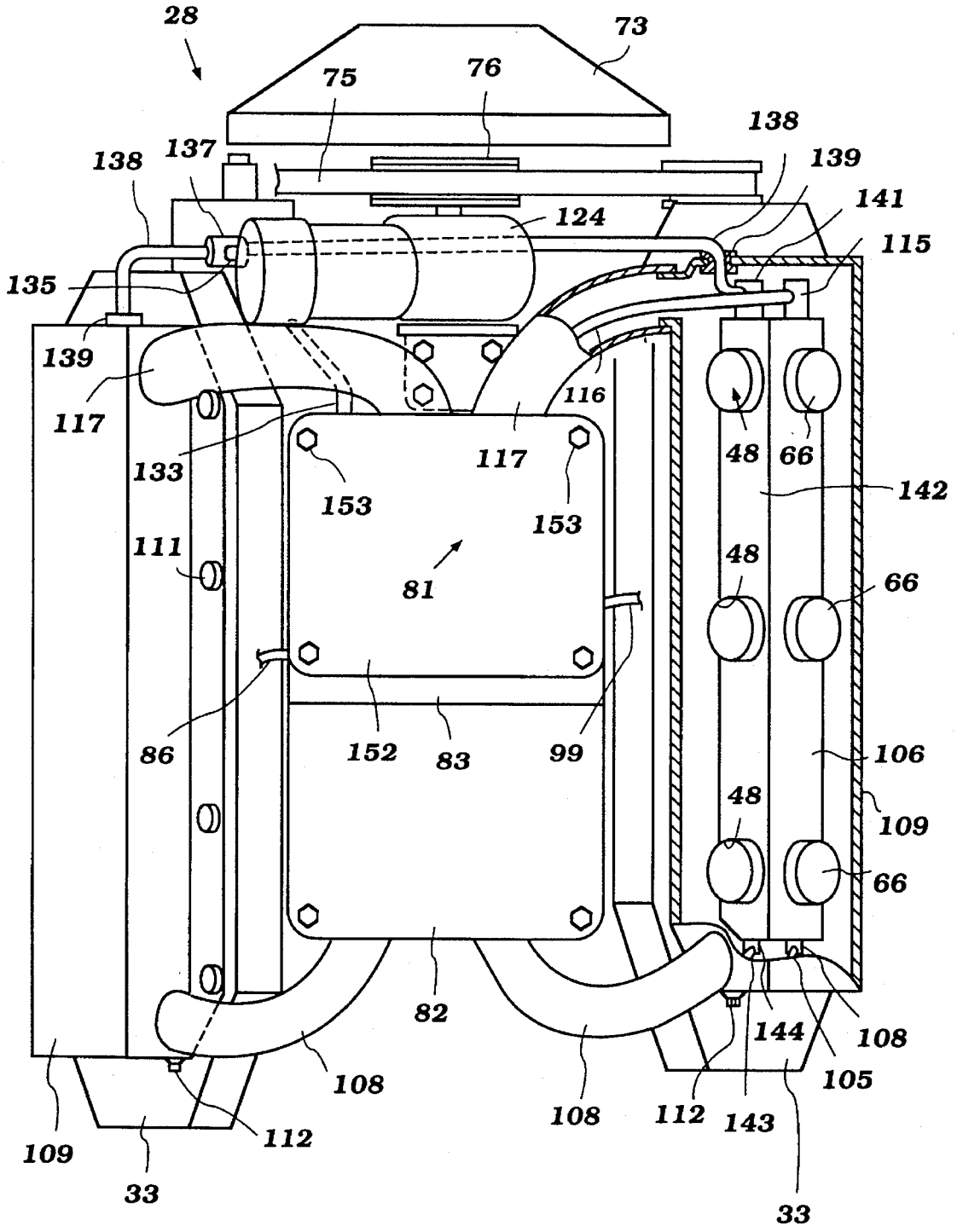
FIG. 3 is a rear elevational view taken in the direction of the arrow 3 in FIG. 2.
Figure 4:
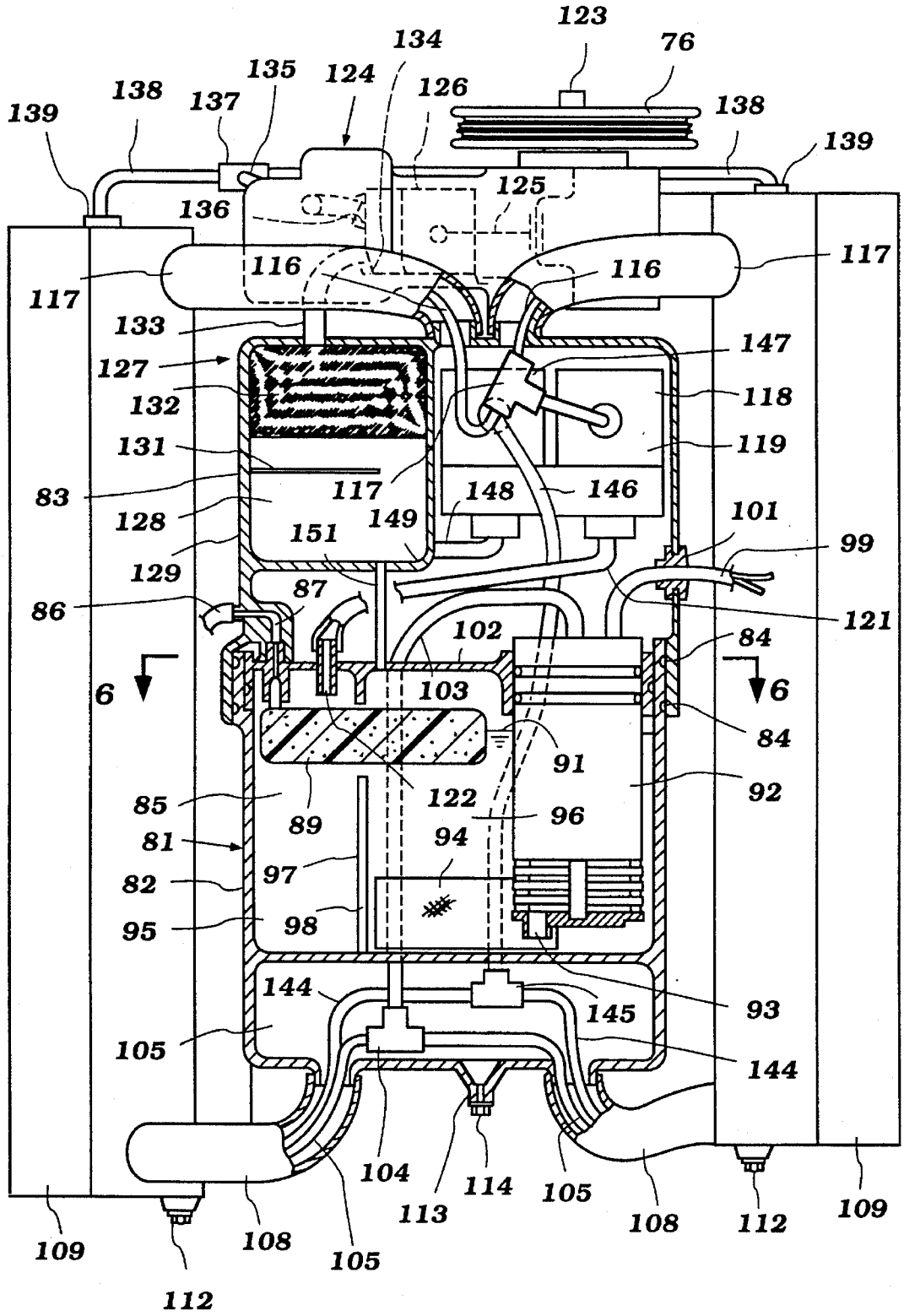
FIG. 4 is a rear elevational view, in part similar to FIG. 3, showing certain of the components broken away.
Figure 5:
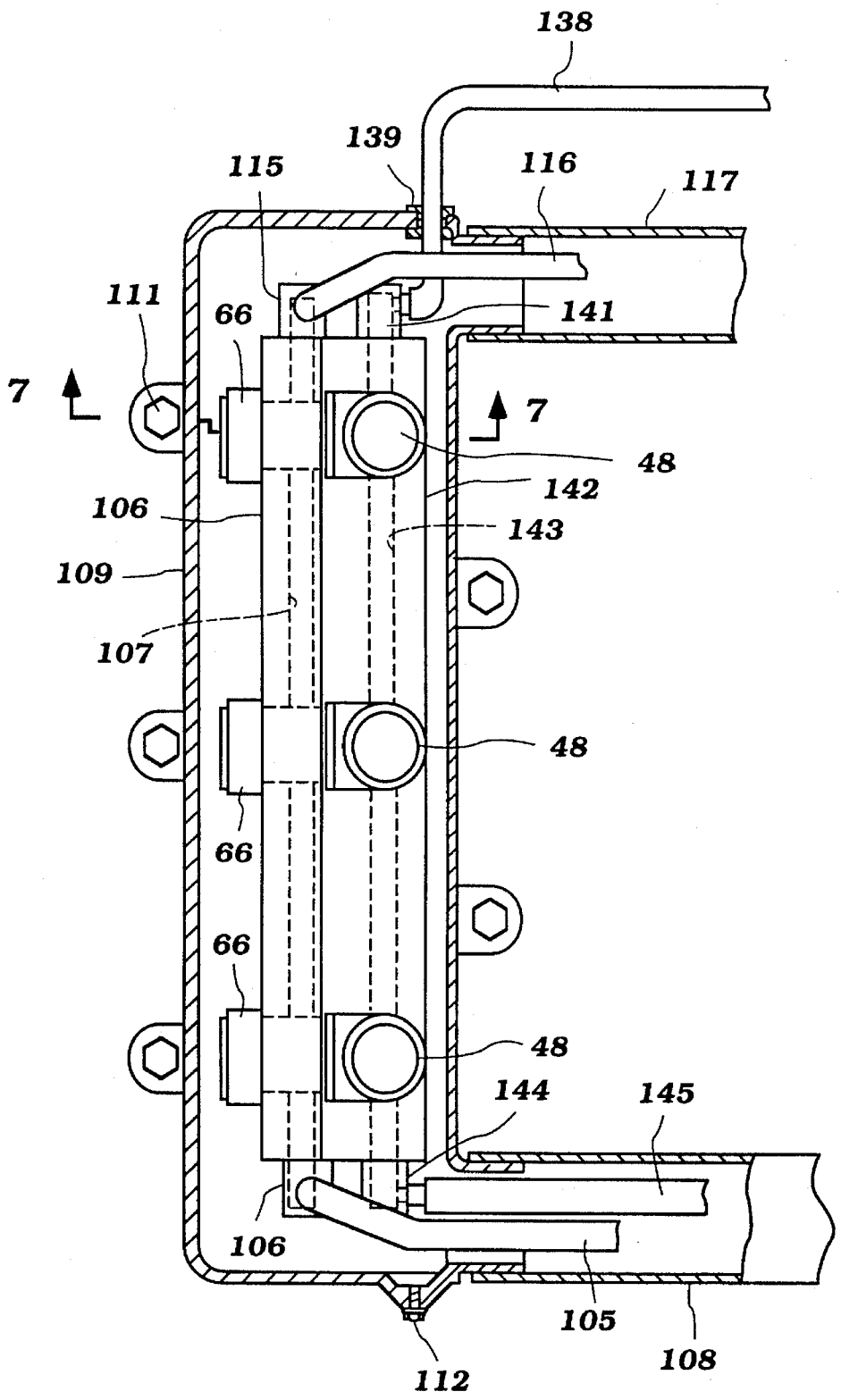
FIG. 5 is an enlarged cross sectional view taken along the line 5—5 of FIG. 2.
Figure 6:
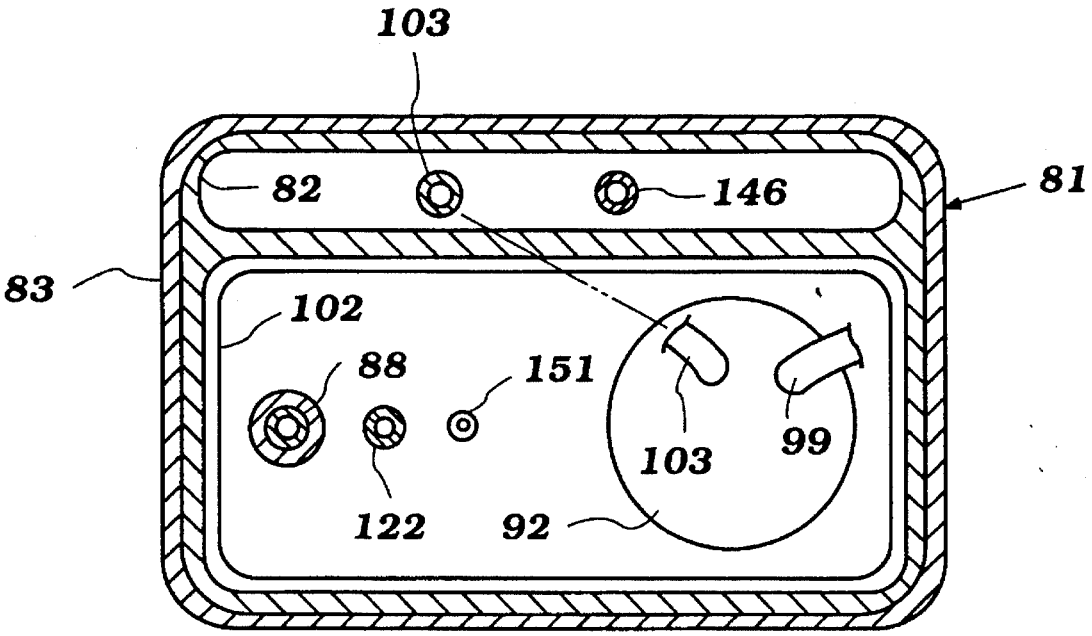
FIG. 6 is a cross sectional view taken along the line 6—6 of FIG. 4.

Referring now in detail to FIGS. 2 and 3, the engine associated with the power head 12 is depicted and identified generally by the reference numeral 28. Since the invention deals primarily with the fuel/air injection for the engine 28, for the most part only the external portion of the engine 28 has been illustrated. It is to be understood that the internal construction of the engine 28, except as may be hereinafter noted, may take any known type of construction and, for that reason, detailed description of the internal components of the engine are not necessary. In the illustrated embodiment, the engine 28 is depicted as being of the V-6 type and operates on the two-stroke crankcase compression principal. As should be readily apparent to those skilled in the art, the invention may be employed with engines of other types than two-cycle V-6 engines. However, certain facets of the invention have particular utility with such engines.

The engine 28 includes a crankcase in which a crankshaft 29 is supported for rotation about a vertically extending axis, as is typical with outboard motor practice and as has already been noted. This crankcase is defined in part by a cylinder block 31 having a pair of angularly disposed cylinder banks 32 in which three individual cylinders are provided. Cylinder head assemblies 33 are affixed to the cylinder banks 32 and, as aforenoted, the engine 28 has an otherwise conventional construction insofar as its internal details are concerned.

An air charge is admitted into the protective cowling 12 through suitable air inlet openings and is inducted into an induction device 34 which, in turn, supplies the air charge to a throttle body 35 in which throttle valves 36 are provided for controlling the speed of the engine in a well known manner. As is typical with two-cycle practice, there may be provided a pair of throttle valves 36 for each pair of cylinders of the cylinder banks 32. The air charge then flows into an intake manifold 37 for induction into the crankcase chambers of the engine, which are sealed from each other as is typical with two-cycle practice. Reed type check valves 38 are provided in the intake manifolds 37 for permitting the air to flow into the crankcase chambers but precluding reverse flow under compression.

The compressed charge is transferred to the combustion chambers of the engine through scavenge passages, one of which appears in cross section in FIG. 2 and is identified generally by the reference numeral 39. As with the other internal details of the engine 28, any known type of scavenging system may be employed.

Figure 7:
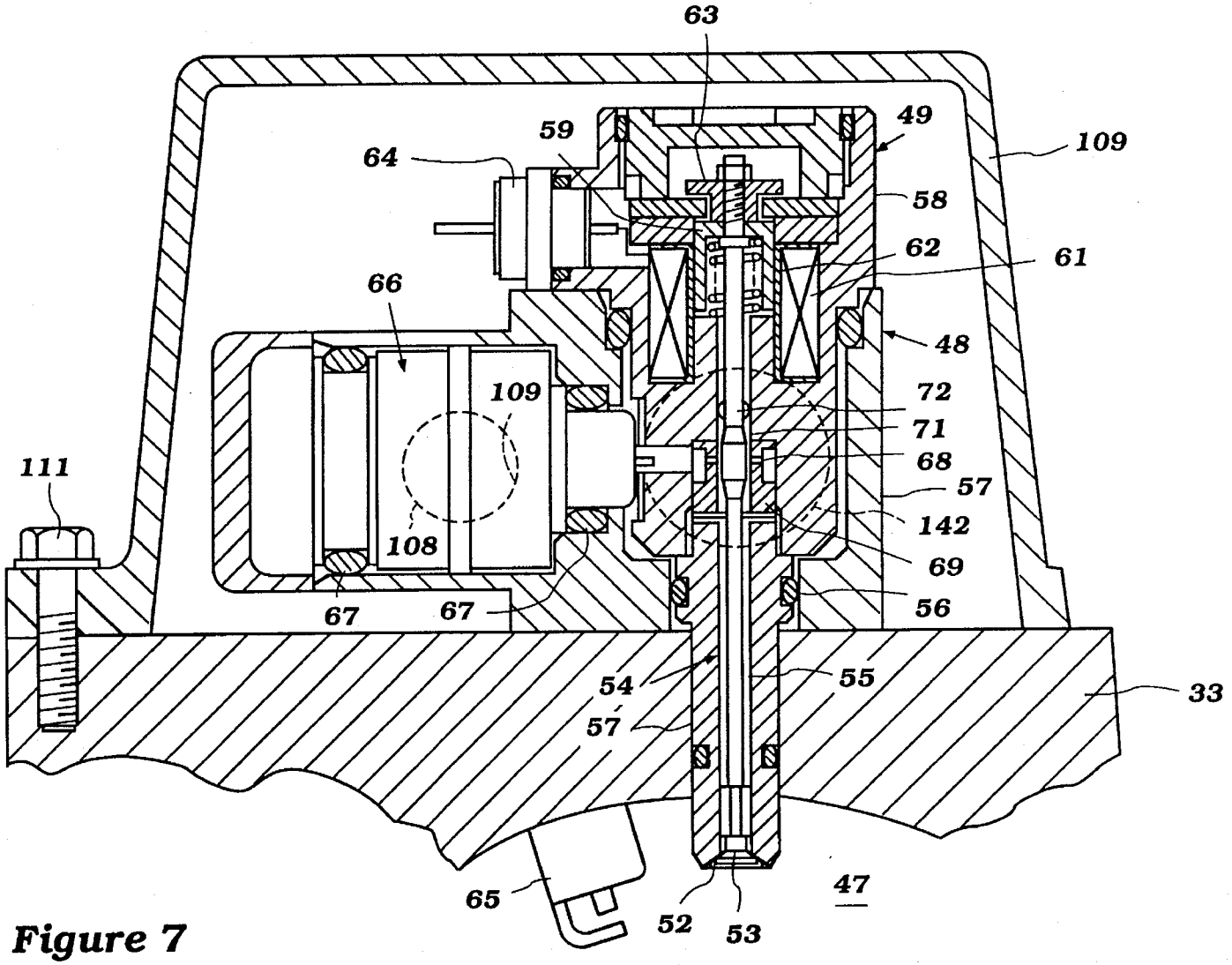
FIG. 7 is an enlarged cross sectional view taken along the line 7—7 of FIG. 5.

A fuel/air charge is delivered to the individual combustion chambers of the engine, one of which appears in FIG. 7 and is identified generally by the reference numeral 47 by means of fuel/air injectors, indicated generally by the reference numeral 48. Although the invention is described in conjunction with a fuel/air injection system, it is to be understood that the invention may be practiced in conjunction with engines that have injectors that inject only fuel. However, certain facets of the invention have particular utility in conjunction with fuel/air injectors, as will be apparent to those skilled in the art.

The fuel/air injectors 48 include a multi-piece outer housing assembly 49 including a pilot or nozzle portion 51 which is mounted into the cylinder head 33 and has a tip that forms a valve seat 52 which extends into the combustion chamber 47. A head or valving portion 53 of an injection valve 54 opens and closes the communication of a chamber 55 formed within the housing assembly 49 with the combustion chamber 47, for a purpose to be described.

The nozzle piece 51 has an annular groove which carries an O ring seal 56 to seal with a second housing piece 57 which is affixed in a suitable manner to the cylinder head 33 and which contains a pilot portion of a third housing piece 58. The upper end of the injection valve 54 has affixed to it an armature 59 that is slidably supported within the housing piece 58 and which is encircled solenoid winding 61. A coil compression spring 62 is engaged with the armature piece 59 which is held in place by an adjustable stop member 63 and normally urges the injection valve 54 to its closed position. The solenoid winding 61 is energized by means of a terminal 64 which is connected to a suitable ECU (not shown) so as to draw the armature 59 and injection valve 54 downwardly to move the valve head 53 away from the valve seat 52 so as to permit a fuel/air charge, generated in a manner to be described, to be injected into the combustion chamber 47. This charge is then fired by a spark plug 65 at an appropriate time interval.

A fuel charge is supplied under pressure to the chamber 55 by means of individual electronic fuel injectors 66 that are mounted to the housing piece 58 with O ring seals 67 being provided around their periphery. Fuel is supplied to the fuel injectors 66 in a manner to be described and the fuel injectors spray into the chamber 55 through one or more orifices 68 formed in a ring piece 69 that is held between the housing pieces 58 and 51. In addition, compressed air is supplied to the chamber 55 from a system as will be described.

The injection valve 57 is provided with a first cylindrical portion 71 that extends in communication with the orifices 68 and the injection valve 54 is in its closed position. In addition, a spherical member 72 is affixed to the injection valve above the cylindrical portion 71 for sealing purposes.

The injectors 48 may be of the precharged type wherein all of the fuel is supplied to the chamber 55 before the injection valve 54 is opened or of the non-precharged type wherein fuel is supplied by the injector 66 when the injection valve 54 is opened. In either event, the air under pressure will assist in atomization of the fuel which enters the combustion chamber 47 through the valve seat 52 when opened by the headed portion 53. Again, the specific details of the fuel injector 48 are not deemed to be necessary to understand the construction and operation of the invention.

The invention is directed primarily to the system which supplies fuel and air to the injectors 48 and its location relative to the engine and this arrangement is best shown in FIGS. 2 and 4 through 6 with the components being shown schematically in FIG. 8 so as to indicate how these components are provided within the various cowlings and enclosures, which will be described.

Referring again to FIGS. 2 and 3, the upper portion of the engine 28 is provided with an accessory drive for driving certain components in addition to components of the fuel/air injection system. These components include a flywheel magneto 73 that is affixed appropriately to the upper end of the crankshaft 29 and which drives the ignition and generating system for the engine including the ignition system for firing the spark plugs 65.

A drive pulley 74 is affixed to the crankshaft 29 below the flywheel magneto 73 and drives a drive belt 75 which, in turn, drives an air compressor drive pulley 76 and an alternator drive pulley 77. An idler tensioner pulley 78 is adjustably carried by the cylinder block 31 for maintaining the appropriate tension on the drive belt 75. An electric starter 79 may be carried by the upper end of the cylinder block 31 and cooperates with a starter gear (not shown) on the flywheel magneto 73 for electric starting of the engine 28.

Figure 8:
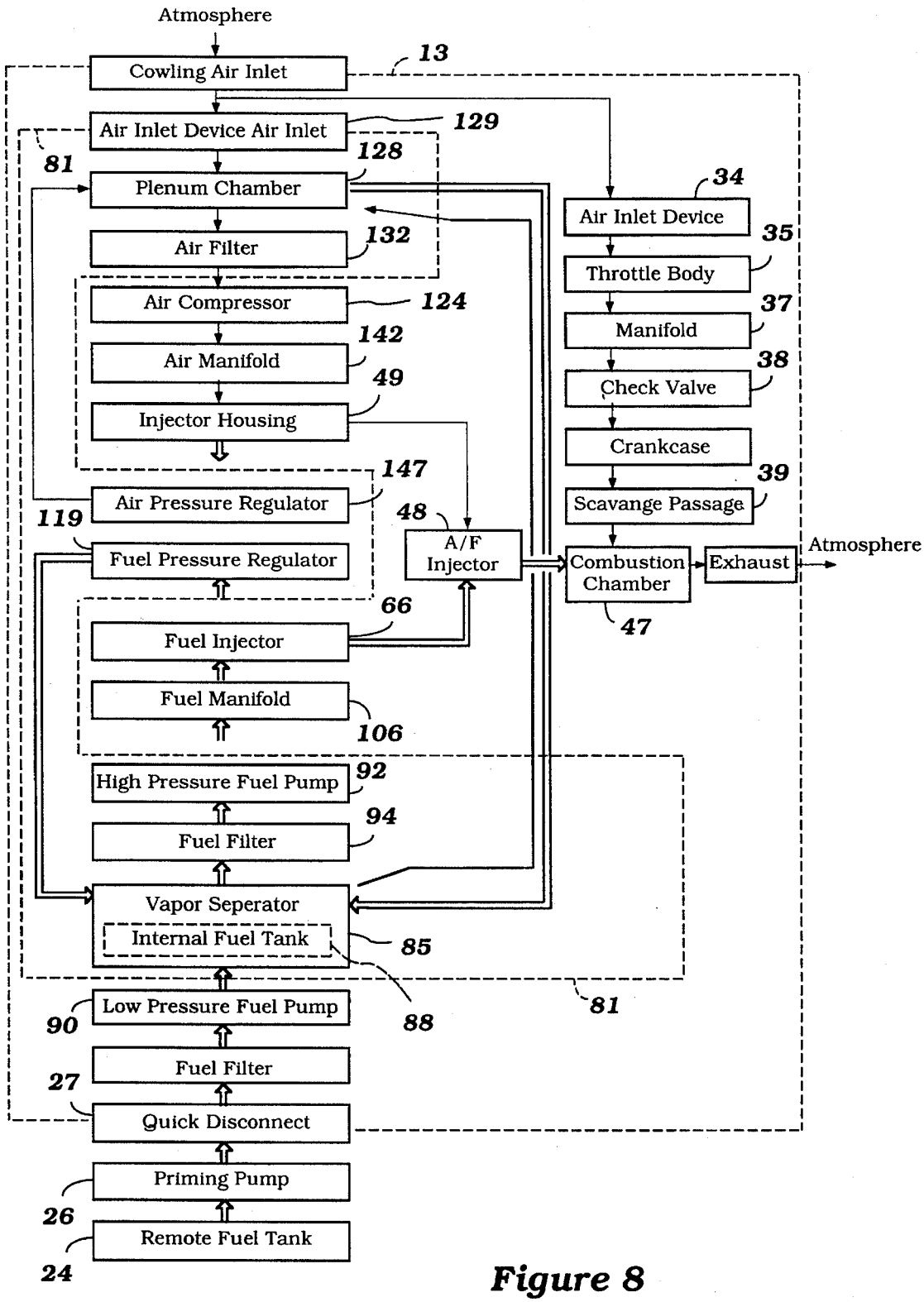
FIG. 8 is a partially schematic view showing certain components of the fuel/air injection system in relation to their orientation On the outboard motor and the manner in which the components are enclosed to avoid fuel leakage externally of the system.

Referring now to both the fuel and air systems for the fuel/air injectors 48, this construction appears in most detail in FIGS. 2 through 6 and the location of the various components appears in FIG. 8. A major component of this fuel/air injection system is a sealed housing assembly, indicated generally by the reference numeral 81, which is positioned conveniently in the valley between the cylinder banks 32 as is clearly shown in FIG. 2. This housing assembly 81 is comprised of interfitting lower and upper housing pieces 82 and 83 respectively with seals 84 being positioned between the housing pieces 82 and 83 so as to in essence provide an air tight inner chamber. A number of components, as will be described, are contained within this inner chamber.

The first of these components comprises a combined vapor separator, fuel storage tank 85 to which fuel is admitted through a conduit 86 that communicates with the quick disconnect coupling 27 and receives fuel under pressure from the remote fuel tank 24 via a low pressure engine driven pump 90 (FIG. 8). An internal passageway 87 terminates at a needle valve 88 which is operated by a float 89 so as to maintain a uniform head of fuel in the vapor separator 85 as indicated by the fuel line 91.

A high pressure fuel pump 92 is supported within the vapor separator tank 85 and has an inlet fitting 93 which is submerged below the fuel level 91 and which draws fuel through a fuel filter 94 submerged in the vapor separator tank 85. It should be noted that the tank 85 is divided into a pair of chambers 95 and 96 by a vertical baffle 97 with the pump 92 being positioned in the chamber 96. The partition wall 97 tends to reduce the likelihood of variations in fuel head during sudden maneuvering and a slot 98 is formed in a lower portion of the baffle wall 97 so as to insure full but restricted communication between the chambers 95 and 96.

Electrical power is supplied to the high pressure fuel pump 92 by an electrical conduit 99 which extends through the housing piece 83 with a sealing grommet 101 being positioned around it.

Because the high pressure pump 92 is contained within the fuel chamber 96 there will be insured adequate supply of fuel to it and also there will not be necessity for a separate supply conduit. In addition, this submersion of the pump 92 gives rise to effective silencing of the operation of the pump 92.

A horizontally extending inner partition wall 102 is interposed between the housing pieces 82 and 83 and forms a closure for the upper end of the fuel chambers 95 and 96 through which the upper end of the high pressure pump 92 extends.

A discharge conduit 103 extends from the discharge side of the high pressure pump 92 and is contained within the housing assembly 81. This discharge line 103 communicates with a T-fitting 104 positioned in a further chamber 105 formed at the lower portion of the housing assembly 81 between the vapor separator and fuel tank portion 85. The T-fitting 104 serves a pair of branch conduits 105 which extend to respective fuel rails or manifolds 106 (FIGS. 3 and 5) that are associated with each cylinder head 33 and which form the means for supplying fuel to the fuel injector 66 of the fuel/air injectors 48 of the respective cylinder banks. An internal supply conduit 107 of the fuel rails 106 serve this purpose.

It should be noted that the fuel supply lines 105 are contained within conduits 108 which have a sealing engagement with the lower end of the housing assembly 81 and specifically its chamber 105. In addition, the conduits 108 are sealingly engaged with cover plates 109 that are affixed to each cylinder head 33 by fasteners 111 so as to form an enclosure for the fuel/air injectors 48 and the fuel rails 106. Because of this sealed arrangement, any fuel leakage which might occur either from the T-fitting 104, conduit 103 or conduits 105 or fuel rails 106 will be collected internally of the various enclosures and cannot flow out on to the engine.

The enclosures 109 are formed with drains 112 at their lower portions so as to permit any accumulated fuel to be drained. In a like manner, the housing portion 105 is formed with a drain 113 in which a drain plug 114 is provided for a similar purpose.

The upper ends of the fuel rails 106 are provided with return fittings 115 which are also contained within the enclosures 109 and which communicate with return lines 116. These return lines 116 are contained within external conduits 117, again to prevent the external leakage of fuel, which conduits 117 extend into the upper end of the housing assembly 81 as do the fuel return conduits 116. The conduits 116 are joined at a T-fitting 117 contained within a chamber formed in one side of the upper portion of the housing piece 83 which T-fitting terminates in a pressure regulator conduit 118 that communicates with a fuel pressure regulator 119.

The fuel pressure regulator 119 regulates the pressure of fuel supplied tothe fuel injectors 43 through the fuel rails 106 by dumping excess pressure back to the inlet side of the high pressure pump 92 and specifically to the chamber 85 through a return line 121. The return line 121 has a return fitting 122 that extends through the upper wall 102 of the vapor separator line 85. Hence, it should be readily apparent that not only the high pressure fuel supply lines but all fittings and conduits associated therewith are completely enclosed. Hence, any leakage from any of these components will all be contained either within the cylinder head cover plates 109, the housing 81 or conduits 108 and 117 so as to insure against any external leakage of fuel.

The air supply will now be described by reference to the same figures. As has been noted, the drive belt 75 drives a air compressor drive pulley 76. This drive pulley 76 is connected to the crankshaft 123 of a single piston, reciprocating type compressor 124. The crankshaft 123 is coupled by means of a connecting rod 125 to a piston 126 which reciprocates within a bore of the cylinder of the compressor 124.

An air inlet device, indicated generally by the reference numeral 127 is provided within the housing assembly 81 for delivering filtered air to the air compressor 124. The air inlet device 127 includes a plenum chamber 128 formed by the upper housing member 83 and into which atmospheric air may be drawn from within the protective cowling 13 through an atmospheric air inlet 129. A baffle 131 divides the plenum chamber 128 into a lower portion, in which the air inlet opening 129 is provided and an upper portion in which a filter media 132 of any known type is provided. The filter media 132 will extract foreign particles from the air which is drawn into the plenum chamber 128 through the inlet opening 129. This filtered air is then delivered to an outlet opening 133 which extends to the cylinder in which the piston 126 is reciprocating. A reed type check valve 134 is provided in this inlet conduit to permit air to flow into the cylinder when the piston 124 moves downwardly and to preclude reverse flow when the piston 126 moves upwardly to compress the air charge.

The air which has been compressed by the upward movement of the piston 126 is then discharged through a discharge conduit 135 in which a delivery check valve 136 is provided which check valve permits flow from the cylinder to the conduit 135 but precludes. flow in a reverse direction.

The conduit 135 supplies compressed air to a T-fitting 137 which, in turn, delivers the compressed air to a pair of conduits 138 which extend from the valley of the engine between the cylinder banks 32 and which enters the chambers formed by the covers 109 through a sealing grommet 139. The conduits 138 register with inlet fittings 141 of an air manifold, indicated generally by the reference numeral 142 which may, as in the illustrated embodiment, be formed integrally with the fuel rails 106 of the respective cylinder banks. The air manifold 142 has a supply passage 143 which delivers air to the individual fuel/air injectors 48. As has been previously noted, these supply passages 143 intersect the portion of the fuel/air injector (FIG. 7) where the orifices 68 are provided in the ring like number 69 so as to flow into the chambers 55 of the respective fuel/air injectors 48.

A return conduit 144 is provided at the opposite end of each of the air manifolds 142 and communicates with respective return air passages 145 which also extend through the conduits 108. The return conduits 144 are connected at their opposite ends at a T-fitting 145 (FIG. 4) which is positioned in the lower chamber 105 of the housing assembly 81. A further return air conduit 146 extends upwardly through the housing assembly 81 terminates at an air pressure regulator 147 positioned immediately adjacent the fuel pressure regulator 119.

The air pressure regulator 147 regulates the air pressure that is supplied to the fuel/air injectors 48 by dumping excess air through a return air conduit 148. To avoid noise and to preclude the discharge of any fuel vapors which may enter the air system from the fuel/air injectors 48, the conduit 148 extends through a small port 128 of the air inlet device 127. The baffle 131 and filter media 132 will extract fuel particles and cause them to condense and collect in the bottom of the plenum chamber 128. A drain conduit 151 will permit these condensed fuel particles to be returned back to the fuel reservoir 85.

A removable cover plate 152 (FIG. 3) is affixed to the upper housing piece 83 by means of a plurality of threaded fasteners 153 for ease of removal and so that the filter element 132 and fuel pressure regulator 119 and air pressure regulator 147 may be serviced.

It should be readily apparent that the described construction insures that fuel from the high pressure fuel injected system cannot escape and enter into direct contact with the engine 28. All of the fuel is contained within the covers 109, conduits 117 or 108 or the housing assembly 81 so that it will be insured that fuel cannot escape to the atmosphere. In addition, any fuel which may enter the air system of the fuel/air injectors will also be returned to the plenum chamber 128 for separation so that the air compressor 124 need not pump any liquid fuel. Furthermore, since the air and fuel pressure regulators 147 and 149, air inlet device 127 for the air compressor 124 and fuel vapor separator 85 are all positioned in the valley between the cylinder banks 32, the length of the conduit serving each cylinder bank will be substantially the same and hence there will be no substantial flow differences between the fuel/air injectors 48 of the respective cylinder banks. As a result, an extremely compact and yet very safe system is provided that permits the adaption of high pressure fuel injection for an outboard motor without any danger and while offering extremely good performance.

Of course, the foregoing description is that of a preferred embodiment of the invention and various changes and modifications may be made without departing from the spirit and scope of the invention, as defined by the appended claims.

I claim:

1. A high pressure fuel/air injection system for an internal combustion engine comprising a plurality of fuel/air injectors positioned in a vertical array, a vertically extending air delivery manifold for delivering high pressure air to said fuel/air injectors, means for delivering a source of high pressure air to a vertically upper end of said air delivery manifold, an air pressure regulator for regulating air pressure by dumping excess air to a relief, a source of high pressure fuel including a vapor fuel separator for delivering high pressure fuel to said fuel/air injector, and means for returning the return from said air pressure regulator to said vapor fuel separator.

2. A high pressure fuel/air injection system as set forth in claim 1 wherein the engine comprises a V-type internal combustion engine having angularly disposed cylinder banks each with a plurality of cylinders, their comprising a plurality of vertically arrayed fuel injectors for each cylinder bank, each supplied with regulated high pressure air.

3. A high pressure fuel/air injection system as set forth in claim 2 wherein the vapor fuel separator is disposed in the valley between the cylinder banks.

4. A high pressure fuel/air injection system as set forth in claim 3 wherein the engine forms a powering internal combustion engine of a power head of an outboard motor supported for tilt adjustment.

5. A high pressure fuel/air injection system as set forth in claim 4 wherein the vapor fuel separator comprises a fuel cavity to which fuel is delivered from a fuel pump and a float operated needle valve for controlling the level of fuel in said fuel cavity.

6. A high pressure fuel/air injection system as set forth in claim 1 wherein the vapor fuel separator comprises an outer housing defining a fuel cavity to which fuel is delivered and an air cavity above said fuel cavity and connected thereto by a conduit.

7. A high pressure fuel/air injection system as set forth in claim 6 wherein the means for delivering high pressure air to the fuel/air injectors comprises an air compressor drawing air from the air cavity of the fuel vapor separator for compression thereby.

8. A high pressure fuel/air injection system as set forth in claim 7 wherein the air chamber is offset to one side of the fuel chamber and the air pressure regulator is disposed in the area to the side of the air chamber.

9. A high pressure fuel/air injection system as set forth in claim 8 wherein the engine comprises a V-type internal combustion engine having angularly disposed cylinder banks each with a plurality of cylinders their comprising a plurality of vertically arrayed fuel injectors for each cylinder bank, each supplied with high pressure air regulated as set forth in claim 1.

10. A high pressure fuel/air injection system as set forth in claim 9 wherein the vapor fuel separator is disposed in the valley between the cylinder banks.

11. A high pressure fuel/air injection system as set forth in claim 10 wherein the engine forms a powering internal combustion engine of a power head of an outboard motor supported for tilt adjustment.

12. A high pressure fuel/air injection system as set forth in claim 7 further including a filter media filling said air chamber.

13. A high pressure fuel/air injection system as set forth in claim 12 wherein the atmospheric air is also delivered to the air chamber for delivery to the air compressor.

* * * * *